United States Patent [19]

Moisiuk

[11] 4,037,283

[45] July 26, 1977

[54] ELECTRIC STIPPLING DEVICE

[76] Inventor: David Moisiuk, 103 Quincy Drive, Regina, Saskatchewan, Canada

[21] Appl. No.: 711,281

[22] Filed: Aug. 3, 1976

[51] Int. Cl.[2] ..... B43L 19/00

[52] U.S. Cl. ..... 15/4; 15/3; 15/3.53; 33/27 L

[58] Field of Search ..... 15/3, 4, 3.53, 22 R; 132/73.6, 75.8; 310/50; 33/27 L; 72/76; 30/164.9

[56] References Cited

U.S. PATENT DOCUMENTS 2,858,703 11/1958 Willcox ..... 310/50 X 3,774,255 11/1973 Pao ..... 15/3.53

FOREIGN PATENT DOCUMENTS 978,876 11/1950 France ..... 310/50

368,395 5/1963 Switzerland ..... 15/3

*Primary Examiner*—Edward L. Roberts

[57] ABSTRACT

An electric stippling device includes a housing within which is positioned an electric motor, a rotatable eraser member operably connected to the motor for rotation therewith and a stippling shaft member operably connected to an opposite end of the motor for reciprocatory movement.

3 Claims, 2 Drawing Figures

ELECTRIC STIPPLING DEVICE

BACKGROUND OF THE INVENTION

The present invention relates to electric stippling devices and more particularly to such a device in which a stippling member and an eraser member are operably connected to a single motor.

Marking machines in which a marking element is driven reciprocably by an electrical driver have been known heretofore. Such machines utilize an electrical driver of the pushtype. A device of this character is disclosed in U.S. Pat. No. 3,440,861 issued Apr. 29, 1969 to D. Oehlerking. Also known heretofore were electric erasing machines in which an eraser is mounted within a rotatable chuck. Such machines were adapted to be held in the hand of the user. However, there was no device available prior to the present invention for stippling a surface and for being able to selectively remove the stipples or dots with the same device. The convenience of having a single instrument capable of performing both functions through the use of a single motor makes the availability of such an instrument important in the fields of graphic art and architecture.

SUMMARY OF THE INVENTION

It is one object of the invention to provide an electric stippling device capable of both producing a stippling effect and of selectively erasing portions of the stippled areas.

It is another object of the invention to provide an electric stippling and erasing device in which both the stippling and erasing members are operably connected to a single motor.

Other objects and advantages of the invention will become readily apparent from the following description of the invention.

According to the present invention there is provided an electric stippling device comprising in combination: an elongated housing; an electric motor mounted within an intermediate section of the housing, a rotatable motor shaft extending from each of the opposed ends of the housing longitudinally of said housing; an eraser member mounted adjacent one end of the housing and projecting therefrom, the eraser member being connected to the motor shaft extending from one end of the motor to be rotatable therewith; a stippling shaft member mounted within the housing adjacent the other end of the housing having a stippling point affixed thereto; means operably connecting the stippling shaft member with the motor shaft extending from the other end of the motor and adapted to convert the rotary movement of the motor shaft into reciprocatory movement of the stippling shaft member; and means for selectively activating the motor and thereby rotating the eraser member and reciprocating the stippling shaft member.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
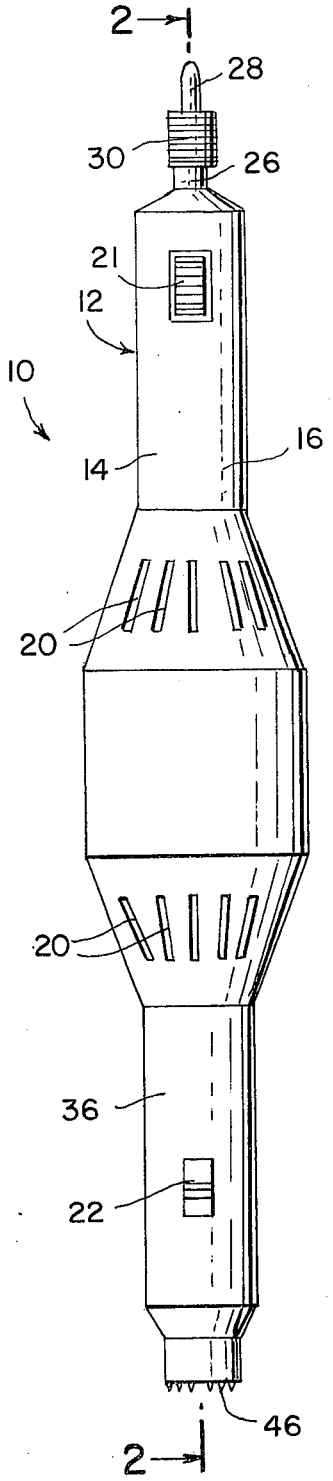
FIG. 1 is an elevational view of an electric stippling device embodying the features of the invention.
Figure 2:
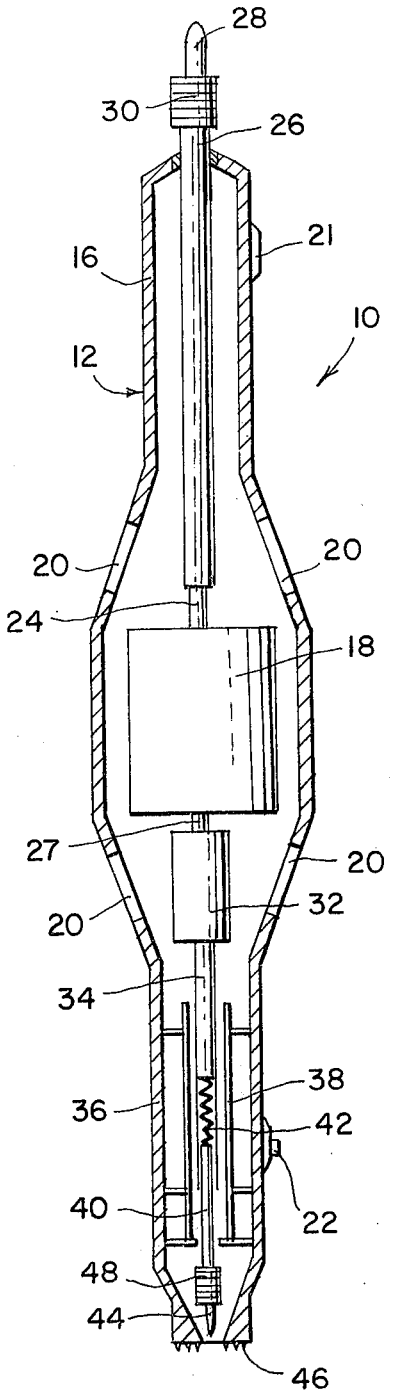
FIG. 2 is an elevational view of the stippling device shown in FIG. 1, partly in cross-section, taken along line 2—2 thereof.

Referring to the drawings there is shown generally, by reference numeral 10, an electric stippling device constructed in accordance with the invention.

The device comprises an elongated housing 12, which may be made of a synthetic plastics material, and formed in complementary mating half-sections 14, 16. The intermediate section of the housing is enlarged so as to accommodate therein an electric motor 18. Slots 20 may be formed in the intermediate housing section for the purpose of inducing a stream of cooling air past the motor. Although not shown it will be appreciated that the motor may either be battery operated, in which even the batteries will be positioned in a suitable location within the housing, or the motor may be powered by connection to a household source of electric supply in which event a power card would be provided to effect such connection. An on-off switch 21 and a variable speed switch 22 are desirably provided to interconnect the motor and its source of electric supply. Such switches are conventional and readily available commercially. Therefore, the present specification will not be encumbered with a detailed description of the constructional details thereof.

Extending from one end of the motor is a motor shaft 24. Secured to the motor shaft to be rotatable therewith is an elongated hollow tube 26. Adjacent the outer extremity of the metal tube an eraser member 28 is positioned therewithin and clamped into close engagement by clamping means 30 which may be of any suitable construction. The eraser member, however, should be clamped within the tube 26 sufficiently so as to insure that the eraser member rotates with the tube.

Extending from the opposed end of the motor is motor shaft 26 which may be the same as shaft 24. Shaft 27 is connected by means of a mechanical gear box 32 with a piston 34. The gear box may contain a gear train and, if necessary, a crank element capable of translating the rotary motion of shaft 27 into reciprocatory movement for piston 34. It will be understood that any of the conventional mechanical arrangements for the conversion of rotary motion into reciprocatory motion are utilizable providing they can meet the space requirements of the housing. Within the lower section 36 of the housing there is fixedly mounted a guide sleeve 38. Within such guide sleeve there is located a stippling shaft 40. The stippling shaft is resiliently connected to piston 34 by means of a tension spring 42 such that the stippling shaft is reciprocable together with the piston. However, the resilient connection between the piston and stippling shaft is such as to limit the force exerted by the point 44 at the end of the stippling shaft during its downward reciprocatory movement. This serves to prevent the point from penetrating the surface being stippled.

The lower extremity of the housing is provided with a plurality of raised projections 46 which are engageable with the surface to be stippled during the stippling operation. By so limiting the contact area between the housing and surface being treated unnecessary wear and risk of damage to such surface is minimized.

The point 44 comprises an element such as a graphite rod adapted to create a series of dots on the surface in a selected pattern and with the desired degree of intensity. Clamping means 48 are provided for securing the point to the stippling shaft and such clamping means are conventional and may take any form suitable to fixedly connect the point and stippling shaft.

From the foregoing it will be seen that a unitary assembly has been provided for stippling a surface and for erasing any portion of the stippled area that may be required during the stippling process. The device employs to advantage a single motor for both the rotatable eraser and the reciprocable stippling member.

I claim:

1. An electric stippling device comprising in combination:

an elongated housing;

an electric motor mounted within an intermediate section of said housing, a rotatable motor shaft extending from each of the opposed ends of said housing longitudinally of said housing;

an eraser member mounted adjacent one end of said housing and projecting therefrom, said eraser member being connected to the motor shaft extending from one end of said motor to be rotatable therewith;

a stippling shaft member mounted within said housing adjacent the other end of said housing having a stippling point affixed thereto;

means operably connecting said stippling shaft member with the motor shaft extending from the other end of said motor and adapted to convert the rotary movement of said motor shaft into reciprocatory movement of said stippling shaft member;

and means for selectively activating said motor and thereby rotating said eraser member and reciprocating said stippling shaft member.

2. A stippling device according to claim 1, wherein a plurality of projections are provided on said other end of said housing engageable with the surface to be stippled during the stippling operation.

3. A stippling device according to claim 1, including spring means for resiliently connecting said stippling shaft member to said means for converting the rotary movement of the motor shaft into reciprocatory movement of the stippling shaft member.

* * * * *